United States Patent [19]

Cooper

[11] 4,214,695

[45] Jul. 29, 1980

[54] ONE-PIECE REINFORCED CONTAINER

[75] Inventor: Keith A. Cooper, Elkridge, Md.

[73] Assignee: International Paper Company, New York, N.Y.

[21] Appl. No.: 23,861

[22] Filed: Mar. 26, 1979

[51] Int. Cl.[3] ..... B65D 5/22; B65D 5/46

[52] U.S. Cl. ..... 229/36; 229/31 R; 229/34 R

[58] Field of Search ..... 221/31 R, 31 FS, 33, 221/34 R, 36

[56] References Cited

U.S. PATENT DOCUMENTS

| | | | |
|---|---|---|---|
| 2,217,503 | 10/1940 | Bergstein | 229/34 R |
| 2,435,283 | 2/1948 | Lighter | 229/36 |
| 3,182,913 | 5/1965 | Brian | 229/31 R |
| 3,395,850 | 8/1968 | Kotowick | 229/36 |
| 3,399,819 | 9/1968 | Remmie et al. | 229/31 R |
| 3,810,574 | 5/1974 | Gardner | 229/31 FS |
| 3,904,106 | 9/1975 | Elder | 229/31 R |
| 4,053,101 | 10/1977 | Hart, Jr. | 229/34 |

*Primary Examiner*—Davis T. Moorhead

[57] ABSTRACT

A one-piece reinforced paperboard container suitable for rapid manual filling and assembling is described and claimed. The container has novel multi-purpose corner constructions in that they impart to the container enhanced structural strength while providing a locking feature. Assembling the container requires no manufacturer's joints, eliminating the need for stitching, stapling, taping and the like. The container is suitable for packing many products such as meat.

7 Claims, 6 Drawing Figures

ONE-PIECE REINFORCED CONTAINER

BACKGROUND OF THE INVENTION

This invention relates to a one-piece reinforced paperboard container, carton or box which is suitable for rapid manual filling, and assembling and to the blank from which said container is constructed.

Conventional containers such as regular slotted, overlap slotted and full overlap slotted containers require top cover members to be folded outwardly and the containers turned on a side or end during filling. Thereafter, the filled containers must be turned on their opposite side or end for closure. The containers of this invention can be filled in reduced time as they are filled upright, eliminating the additional step of turning the filled cartons for closure.

Most prior art containers are not suitable for manual assembling, not requiring automated equipment, in that their assembly includes the use of manufacturer's joints requiring stitching, stapling, glueing, taping or some other fastening means. Other prior art containers whose assembly does not require manufacturer's joints do not provide sufficient structural strength, especially to withstand multiple stacking. Prior art containers whose assembly does not require manufacturer's joints and does provide sufficient structural strength may, nevertheless, be undesirable in that they are not filled in an upright position, requiring an additional packing step. Then too, they may require a discrete cover or top as an integral component of the container's securing means and for imparting structural strength to the container. These latter containers cannot be rapidly, manually filled and cannot be easily opened and closed for re-use after filling and securing. Containers of this invention simultaneously satisfy all these criteria; namely, simplified filling and assembly, good structural strength, and reuseability with no deleterious effect thereto.

In addition to the foregoing, the one-piece reinforced containers of the invention are assembled from a one-piece blank in which all its elements are housed within an essentially rectangular form so as to assure very little waste. The containers of this invention incorporate all these desirable features and, at the same time, they have not been described or suggested in the prior art.

SUMMARY OF THE INVENTION

The present invention resides in a one-piece, reinforced paperboard container, carton or box having novel corner constructions connected to its side and end panels. Said corner constructions include diagonally folded corner members which exteriorly abut the side panels, locking wings to secure the corner members and means for securing locking wings into or against the container's bottom panel to complete the container's assembly and impart structural integrity thereto. Said corner constructions are multiplied to reinforce the side walls, which is especially desirable in that it provides enhanced strength for stacking. Additionally, diagonally folded corner members provide acute angle corner support elements to further enhance structural strength.

Containers of the invention are easily constructed from any form of paperboard customarily used in making cartons such as fiberboard or corrugated paperboard. They are easily assembled from a one-piece scored and cut blank without requiring any manufacturer's joints. Accordingly their assembly does not need staples, stitching, glueing, taping or the like.

BRIEF DESCRIPTION OF THE DRAWINGS

The container and blank of the invention having been generally described, a preferred embodiment thereof will be described in detail with reference to the following drawings in which.

DESCRIPTION OF PREFERRED EMBODIMENT

Figure 1:
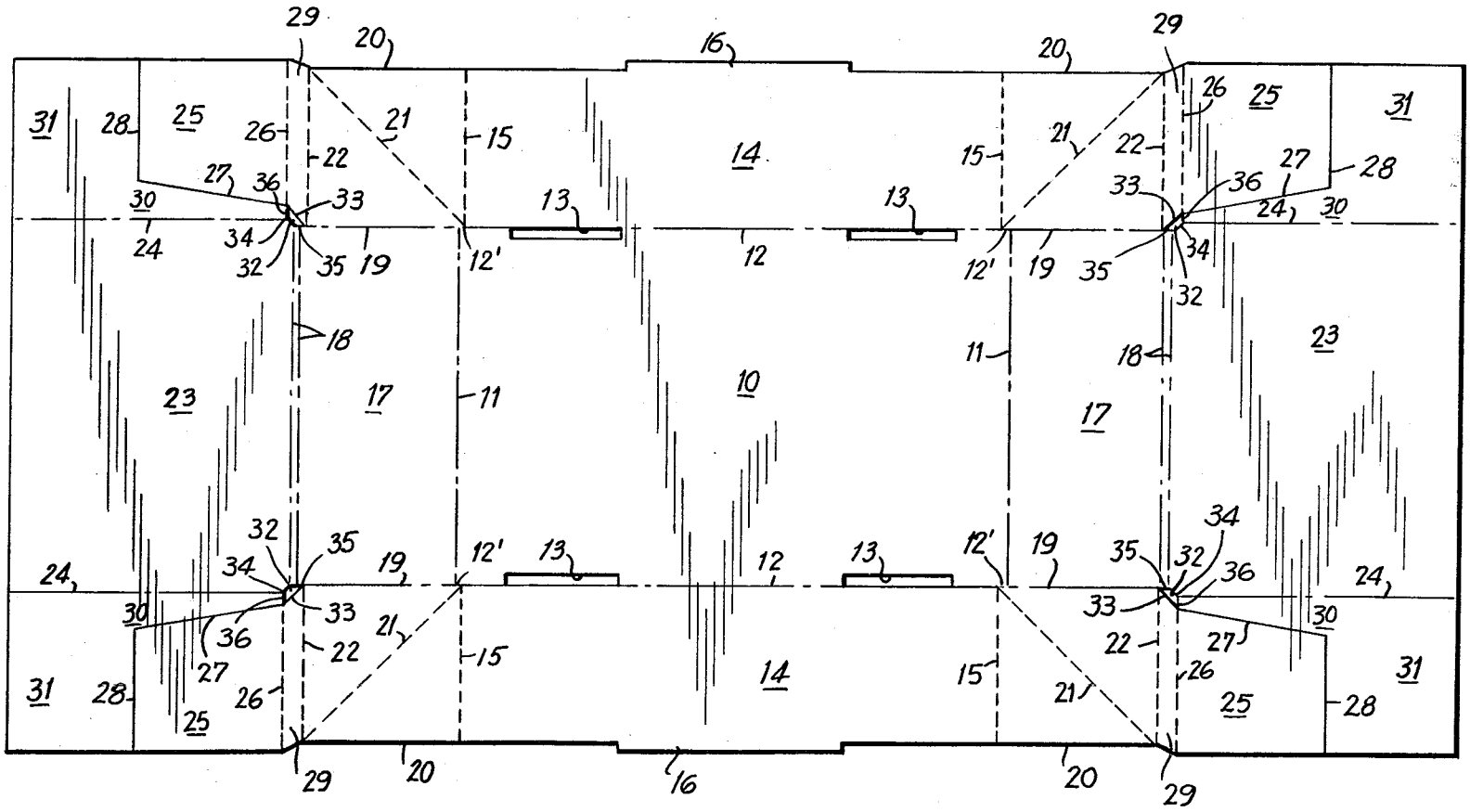
FIG. 1 is a plan view of the cut and scored corrugated paperboard blank from which the container illustrated in FIGS. 2–6 is assembled.

Referring to FIG. 1, a corrugated paperboard blank is shown. The blank includes a generally rectangular bottom panel 10 defined by a first pair first lateral scorelines 11 and a pair of first longitudinal scorelines 12. Bottom panel 10 contains slots 13 situated along and inwardly of scorelines 12 and which are adapted to receive the ends of the locking wings 25. The function of the slots 13 is more fully described below. Two generally rectangular side panels 14 are hingedly connected to bottom panel 10 along first longitudinal scorelines 12, and bounded by first longitudinal scorelines 12 and a pair of second lateral perforated scorelines 15. Aligning tabs 16 protrude outwardly from the outer longitudinal edge of side panels 14. The function of aligning tabs 16 is more fully described below.

Two generally rectangular end panels 17 are hingedly connected to bottom panel 10 along first lateral scorelines 11, and are defined by said first lateral scorelines 11 and third lateral scorelines 18 and a pair of second longitudinal scorelines 19.

Four generally rectangular corner members 20 are hingedly connected to end panels 17 and, to a much lesser extent, bottom panel 10 along second longitudinal scorelines 19 and coinciding offsets 12' (defined by the distance between the respective intersections first lateral scorelines 11 and perforated second lateral scorelines 15 with first longitudinal scorelines 12); hingedly connected to side panels 14 along perforated second lateral scorelines 15; and further defined by second lateral perforated scorelines 15 and fourth lateral scorelines 22 and second longitudinal scorelines 19 and said coinciding offsets 12'. Corner members 20 include diagonal perforated scorelines 21 situated along the diagonal of corner members 20 beginning at the corner defined by the intersection of first longitudinal scorelines 12 and second lateral perforated scorelines 15. In addition to forming the corners of the container, the function of corner members 20 is more fully described below. Four connecting members 29, each approximating the shape of a parallelogram, are hingedly connected to corner members 20 along fourth lateral perforated scorelines 22 and are further defined by opposed fourth lateral perforated scorelines 22 and fifth lateral perforated scorelines 26 and opposed oblique cuts, the third oblique cut 33 running from the intersection of second longitudinal scorelines 19 and fifth lateral perforated scorelines 22 to fifth lateral perforated scorelines 26. Four trapezoidally shaped locking wings 25 are hingedly connected to connecting members 29 along lateral perforated scorelines 26 and first oblique cut 27 and first lateral cut 28. The function of locking wings 25 is more fully described below.

Two cover flaps 23 are hingedly connected to end panels 17 along third lateral double scorelines 18 and further defined by third lateral double scorelines 18 and fourth longitudinal scorelines 24. Four container locking assemblies 30 are hingedly connected to cover flaps 23 along fourth longitudinal scorelines 24 and further defined by fourth longitudinal scorelines 24 first, oblique cuts 27 and lateral cuts 28. Container locking assemblies 30 include four generally rectangular tabs 31 whose lateral dimension is substantial equal to the lateral dimension of side panels 14. The function of these tabs 31 is more fully described below. Container locking assemblies 31 further include substantially triangular portions partially bounded by first oblique cuts 27 and second lateral cuts 36. The function of these substantially triangular portions is more fully described below.

Generally trapezoidal cut-outs 32 are bounded by end panels 17, connecting members 29, cover flaps 23 and container locking assemblies and are defined by third oblique cuts 33 and second oblique cuts 34 (cut 34 running slightly inward from the intersection of third lateral double scorelines 18 with second longitudinal scorelines 19), longitudinal cut 35 and second lateral cut 36. The function of the cut-outs 32 is more fully described below.

Figure 2:
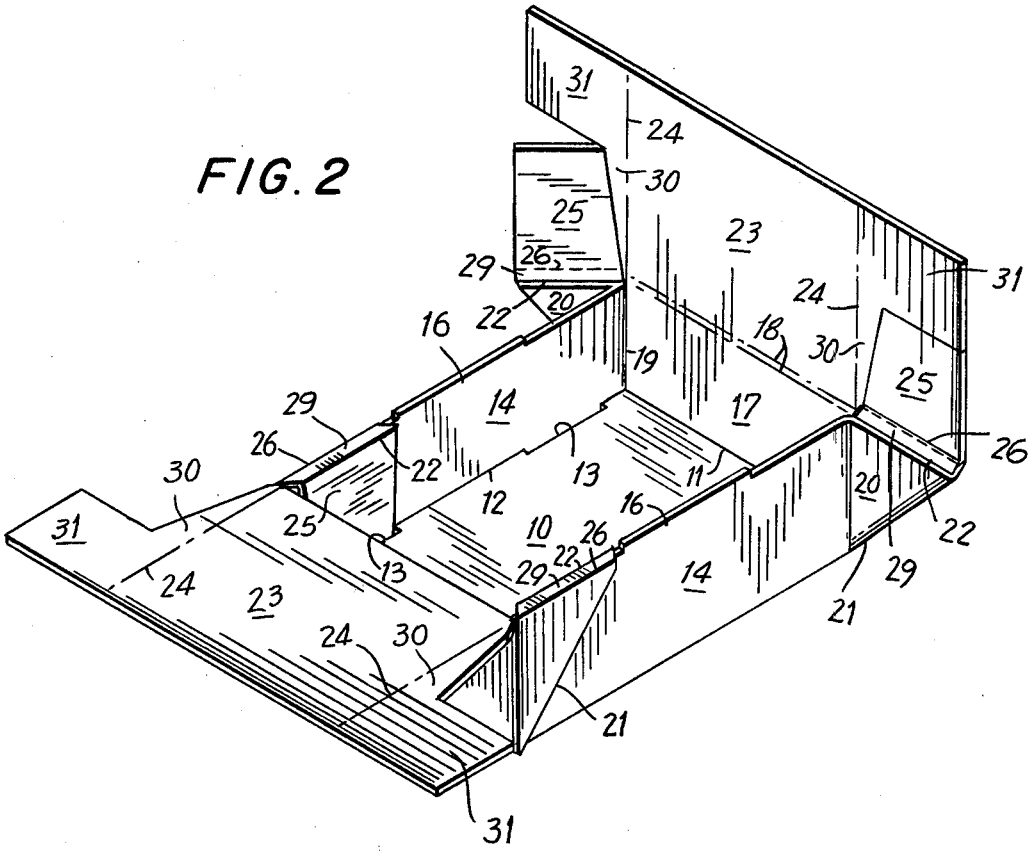
FIG. 2 is a perspective view of the partially assembled container.

The principal steps for assembling the container of the invention from its blank are illustrated in FIG. 2, as follows: side panels 14 and end panels 17 are folded upwardly along first longitudinal scorelines 12 and first lateral scorelines 11, respectively, until they are erect and perpendicular with respect to bottom panel 10, causing corner members 20 to swing outwardly and fold upon themselves diagonally along diagonal perforated scorelines 21 so that second longitudinal scorelines 19 and perforated second lateral scorelines 15 meet to define vertical corners of the carton. The diagonally folded corner members 20 are folded inwardly along said vertical corners defined by second longitudinal scorelines 19 and perforated second lateral scorelines 15, until they abut side panels 14. Then, connecting members 29 are folded downwardly along perforated fourth lateral scorelines 22 until they are horizontal with respect to bottom panel 10, causing the locking wings 25 to extend horizontally over bottom panel 10. Locking wings 25 are then sequentially folded downwardly along perforated fifth lateral scorelines 26 and their ends are placed in slots 13, illustrated in FIG. 2. Finally, cover flaps 23 are folded downwardly along double third lateral scorelines 18 until they are horizontal with respect to bottom panel 10 and then container locking assemblies 30 are folded downwardly along fourth longitudinal scorelines 24 until they are erect and perpendicular to bottom panel 10 and exteriorly abut the outside surface of side panels 14, completing the container's assembly, shown in FIG. 3.

Figure 6:
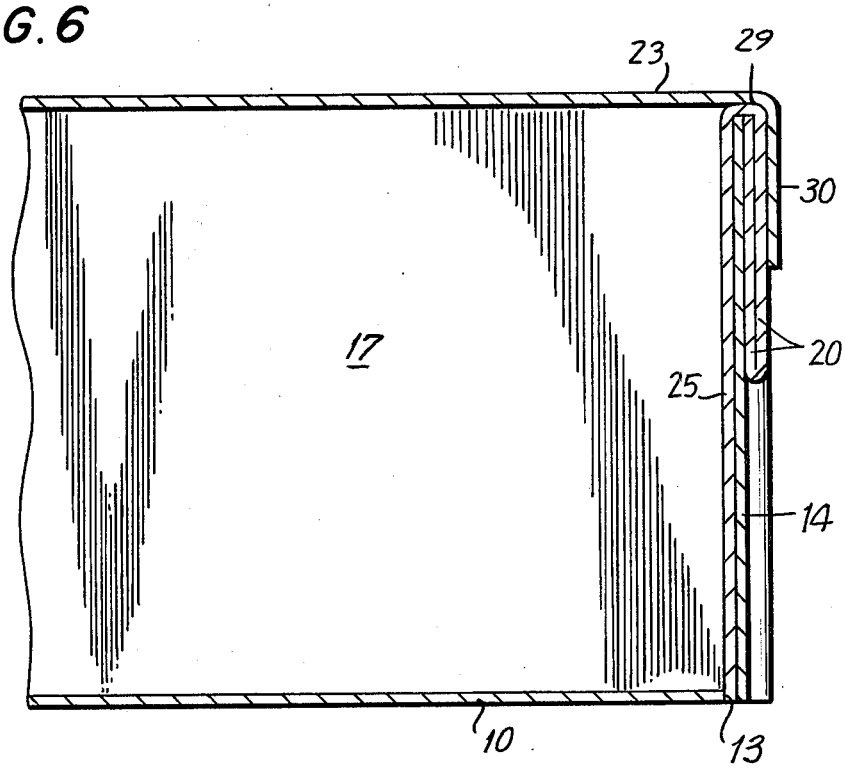
FIG. 6 is a cross-sectional view along line 6—6 of FIG. 3.
Figure 4:
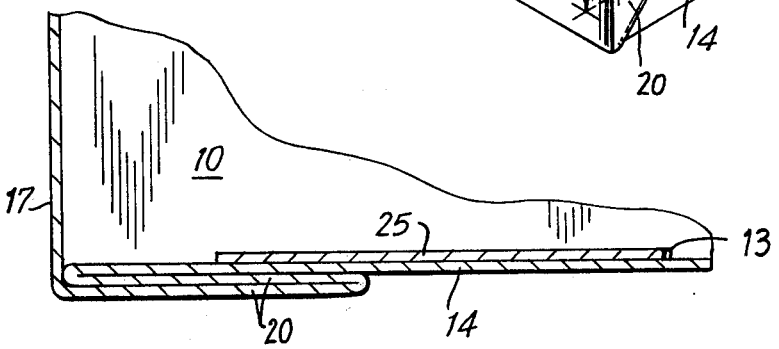
FIG. 4 is a cross-sectional view taken along line 4—4 of FIG. 3.
Figure 5:
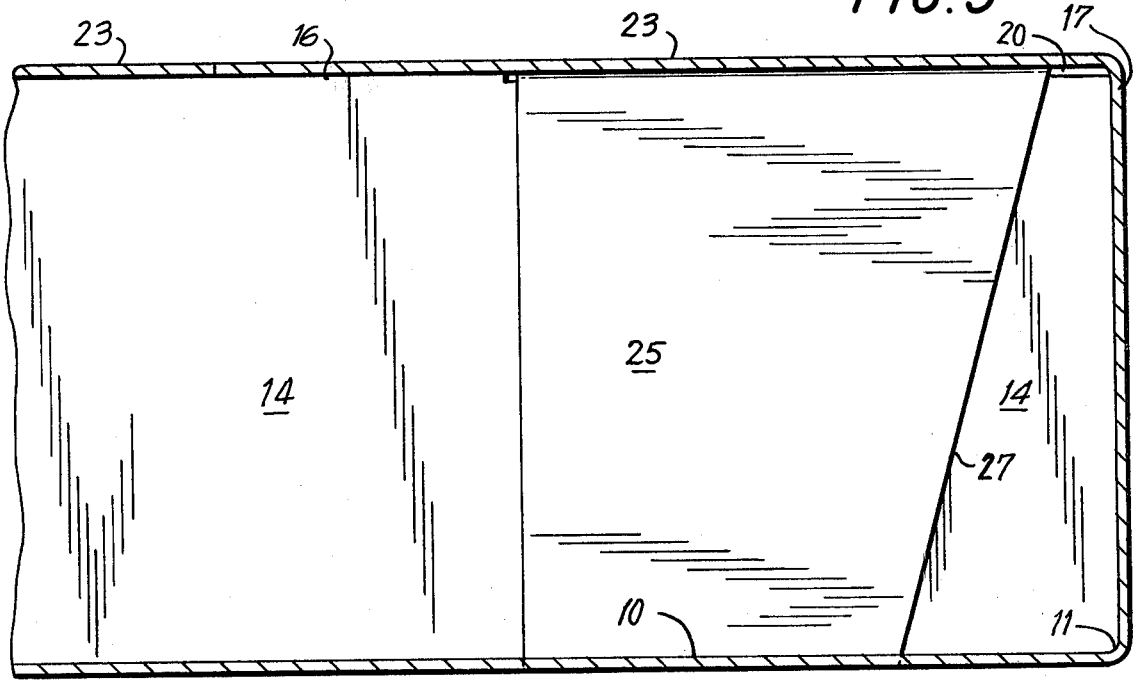
FIG. 5 is a cross-sectional view along line 5—5 of FIG. 3.

The containers corner construction composed of corner members 20, connecting members 29, locking wings 25 and container locking assemblies 30, and their interrelation with side panels 14, running along side panels 14 represents an important feature of containers of the present invention. As illustrated in FIGS. 4–6, the corner constructions have as many as five plies, or layers, of paperboard, and never less than three plies. This multi-ply feature located throughout corner portions imparts enhanced structural strength, especially since about 85% of a container's strength is attributed to its corners. Further, enhanced strength is attributed to the presence of the 45° angle, provided by the folding of corner members 20 along diagonal perforated scorelines 21. It is well known that the presence of support elements at acute angles provides enhanced overall strength as compared with conventional perpendicular support elements. Also, as is apparent from FIG. 2, containers of the invention are structurally secured upon placing locking wings 25 into slots 13. Accordingly, the cover elements (cover flaps 23 and container locking assemblies) are not materially involved in achieving the containers' structural integrity. It follows that the structural integrity of the containers is not detrimentally affected by opening and closing their cover elements.

The aforesaid multi-ply aspect is further illustrated in FIGS. 4–6. FIG. 4 shows areas along the side panels 14 which are three-ply and four-ply. More particularly, from the vertical ends of side panels 14 to where the locking wings 25 abut said said panels 14 there are three plies consisting of, from inside to outside, side panel 14 and folded corner members 25 (2-plies). Then, throughout the area where locking wings 25 are opposed to diagonally folded corner members 20, there are four plies consisting of, from inside to outside, locking wings 25, side panels 20, and diagonally folded corner members 20 (2-plies).

FIG. 5 shows locking wings 25 locked into or secured to bottom panel 10 illustrating the locking feature by which containers of the invention are structurally secured. This view also illustrates the reinforced nature along the side walls.

FIG. 6 further illustrates the multi-ply aspect of the container's corner construction along side walls 14, showing areas having four plies consisting of, from inside to outside, locking wings 25, side panels 14, and diagonally folded corner members 20 (2 plies) are shown in the area in which the locking wings 25 and diagonally folded corner members 25 are opposed on the inside and outside surfaces, respectively, of side panels 14. Additionally, a fifth ply is present throughout the area in which the substantially triangular portions of container locking assemblies 30 abut diagonally folded corner members 20. The substantially triangular portion of container locking assembly 30 overlaps the entire upper longitudinal edge of side panel 14 so that the closed box has no exposed edges.

From the foregoing, it is apparent that the corner construction constitutes a very desirable aspect of containers of the invention. Other advantages of the container are directly attributable to said corner sub-assemblies. For example, since the top or cover is not needed to assure the container's stability, the container can be filled from the top after the container has been essentially fully assembled. This reduces packing or filling time and avoids a requirement for automatic filling and container assembling equipment. Further, the reinforced property of their corner portions enables the containers of the present invention to retain greater structural integrity upon stacking. It follows that containers of the present invention, if constructed from non-corrugated paperboard, can achieve greater strength than is usually associated with such non-corrugated paperboard containers.

As shown, the preferred embodiment includes a securing means to engage locking wings 25 with bottom panel 10 consisting of four generally rectangular slots 13, each positioned along a longitudinal edge of bottom panel 10 in alignment with, and to receive one of, the four locking wings 25 so that tongue and groove type joints are formed as locking wings 25 are placed into slots 13. However, other means are available to secure locking wings 25 to the bottom panel 10. One such means, for example, is frictional engagement of the locking wings 25 against bottom panel 10.

Figure 3:
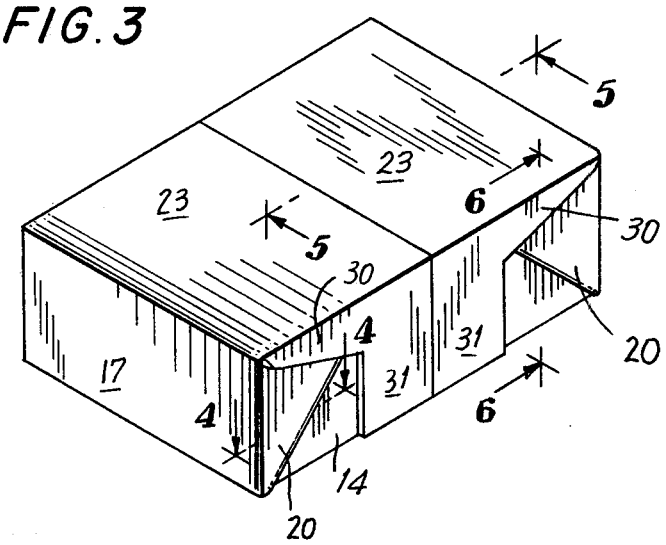
FIG. 3 is a perspective view of the fully assembled container.

As shown in FIG. 3, container locking assemblies 30 are additional support elements, reinforcing side walls 14. This further enhances the container's ability to maintain structural integrity upon stacking. Further illustrated in FIG. 3, cover flaps 23 may be held in place by securing container locking assemblies 30, through their tabs 31, to the outside surface of the side panel 14. Such securing can be accomplished by conventional methods such as strapping or gluing. It follows that the means chosen depends on the container's end use. For example, should a purchaser desire to open and close the container, gluing would be inappropriate. In such case, strapping may be selected and, for example, conventional polypropylene strapping may be used. However, if gluing, or another means of more permanently securing the container, is chosen, then tabs 31 can be provided with an adhesive so that tabs 31 will be secured to a surface of the side panel 14 on contact with sufficient pressure.

Also, the container locking assemblies 30 can be made to secure to the inside surface of the side panel 14 by simply moving scorelines 24 within the inside dimension of the container or inward from a first longitudinal scoreline 12. In this embodiment, it is apparent that containers can be secured by frictional engagement of tabs 31 with bottom panel 10 along the inside surface of side panels 14, requiring no additional securing means. It is readily apparent that containers of the invention afford flexibility with respect to the method and means for sealing them.

Clearly, aligning tabs 16 serve to align the cover by maintaining cover flaps 23 in an essentially horizontal plane. Without these tabs 16, cover flaps 23 may tend to bow downwardly, particularly upon stacking, inasmuch as connecting members 29, spanning upper longitudinal ends of side panels 14, are elevated above the side panel's 14 longitudinal edge a distance substantially equal to the thickness of the carton's construction material. Therefore, the preferred degree of protuberence of tabs 16 above the side panel 14 depends on the thickness of the container's construction material.

Cut-outs 32, as shown in FIG. 1, are employed to facilitate assembling the carton as they provide clearance for the folding of the locking wings 25 and container locking assemblies 30. Without these cut-outs 32, fraying or deterioration of panels 25 and 28 may occur when they are folded into position because they would interfere with one another.

In another embodiment, containers of the present invention have a leak-resistant nature. This is attributable to diagonally folded corner members 20 as they serve as a webbing feature which retards or prevents leaking of fluids from the containers. The container locking assemblies 30 contribute to the leak-resistance of the container by shielding the upper longitudinal edges of the side panels to prevent seepage. According to this embodiment, containers' inside surfaces should be essentially void-free and the container should have no exposed edges. This can be accomplished by frictionally engaging locking wings 25 against bottom panel 10, and thereby eliminating slots 13. Additionally, such containers are preferably constructed from blanks that employ little or no perforated scorelines. It follows that leak-resistant containers of the invention may be less suitable for manual filling than are other containers of the invention. In addition, the paperboard can be impregnated or coated with a fluid barrier material to enhance the containers' overall leak-resistant feature. In this regard, wax, polyethylene, polyvinylidine chloride, polyvinyl chloride, polyvinyl chloride-acetate copolymer, polypropylene or polyethylene co-polymer, for example, can be employed.

Another desirable feature of containers of the invention is that they are constructed from essentially rectangular blanks with very little waste of paperboard. Most conventional containers are assembled from a blank approximating an elongated H form and this wastes much paperboard. The blanks of the invention can be shipped and stored flat. Additionally, the blank permit containers to be easily constructed in that no manufacturer's joints, i.e. no stitching, staples, tape, or glues, are required.

Although the invention has been described above by reference to a preferred embodiment, it will be appreciated that other carton constructions may be devised which are, nevertheless, within the scope and spirit of the present invention and are defined by the claims appended hereto.

What is claimed:

1. A one-piece cut and scored paperboard blank for making a one-piece reinforced container comprising: a generally rectangular bottom panel defined by a pair of first longitudinal scorelines and a pair of first lateral scorelines;

a pair of generally rectangular side panels, each hingedly connected to the bottom panel along one of the first longitudinal scorelines, each of the side panels being defined by one of the first longitudinal scorelines, and by a pair of second lateral scorelines which are offset from and meet said pair of first longitudinal scorelines slightly inwardly from their ends;

a pair of generally rectangular end panels, each hingedly connected to the bottom panel along one of the first lateral scorelines, each of the end panels being defined by one of the first lateral scorelines, and a pair of second longitudinal scorelines;

four generally rectangular corner members hingedly connected to: (a) the side panels along the second lateral scorelines; (b) the end panels along the second longitudinal scorelines; and (c) portions of the bottom panel along the offsets of the first longitudinal scorelines, each corner member containing a diagonal, perforated scoreline beginning at the intersection of the lateral ends of the side panel with the bottom panel, whereby the corner member is adapted to fold along this diagonal scoreline as the side panels and end panels are folded upwardly;

four connecting members, each hingedly connected to a corner member and to a locking wing along a lateral scoreline;

four locking wings, each hingedly connected to a connecting member along a lateral scoreline, the length of each locking wing being substantially equal to the width of each side panel;

a pair of generally rectangular cover flaps, each hingedly connected to an end panel along a third lateral scoreline;

four container locking assemblies, each hingedly connected to a cover flap along a fourth longitudinal scoreline, and each cut free from a corner locking wing along a first oblique cut and a first lateral cut, so that the outermost portion of each container locking assembly is a generally rectangular tab whose length is substantially equal to the width of each side panel; and four generally trapezoidal cut-outs, each of which communicates with an end panel along a longitudinal cut, with a container locking assembly along a second lateral cut, with a connecting member along a second oblique cut, and with a cover flap along a third oblique cut, the second and third oblique cuts being in parallel relationship.

2. The blank according to claim 1 further comprising four generally rectangular slots located in the bottom panel, each slot being positioned along one of the first longitudinal scorelines to be aligned with and to receive one of the locking wings upon assembly of the container from the blank.

3. The blank according to claim 2 further comprising two generally rectangular aligning tabs, each of which is situated generally medially along an outer longitudinal edge of a side panel and protrudes outward from the side panel a distance substantially equal to the thickness of the paperboard whereby the cover flaps of the assembled container will rest upon the aligning tabs.

4. The blank according to claim 3 in which the cover flaps are hingedly connected to the end panels along double lateral scorelines.

5. The blank according to claim 4 wherein the paperboard is corrugated paperboard.

6. A leak-resistant one-piece reinforced container constructed from paperboard coated or impregnated with a fluid barrier material and comprising:

a generally rectangular bottom panel;

a pair of generally rectangular side panels hingedly connected to opposite sides of the bottom panel;

a pair of generally rectangular end panels hingedly connected to opposite ends of the bottom panel;

four diagonally folded corner members hingedly connecting the end panels to the side panels so that the end panels meet the side panels to form a corner and the corner members fold to exteriorly abut the side panels;

four connecting members hingedly connected to the diagonally folded corner members along their upper lateral edges to span portions of the upper longitudinal edges of the side panels;

four locking wings hingedly connected to the connecting members and interiorly abutting the side panels;

securing means to engage the locking wings with the bottom panel thereby imparting structural integrity to the container;

a pair of generally rectangular cover flaps hingedly connected to the upper lateral edges of the end panels;

aligning tabs situated medially along the upper longitudinal edge of the side panels and protruding above the side panels a distance substantially equal to the thickness of the paperboard thereby preventing the cover panels from bowing downward particularly upon stacking; and four container locking assemblies hingedly connected to the longitudinal edges of the cover flaps, each locking assembly comprising (a) a substantially triangular portion exteriorly abutting one of the side panels and one of the corner members to thereby retard leakage along the upper longitudinal edge of the side panel, and, (b) a generally rectangular tab having a length substantially equal to the width of a side panel and communicating with the exterior surface of the side panel to thereby impart additional support to the container.

7. The container according to claim 6 in which the paperboard is corrugated paperboard.

* * * * *